US007878927B2

(12) United States Patent
Hebert et al.

(10) Patent No.: US 7,878,927 B2
(45) Date of Patent: Feb. 1, 2011

(54) HIGHLY-NEUTRALIZED ACID POLYMER COMPOSITIONS HAVING A LOW MOISTURE VAPOR TRANSMISSION RATE AND THEIR USE IN GOLF BALLS

(75) Inventors: Edmund A. Hebert, Mattapoisett, MA (US); Derek A. Ladd, Acushnet, MA (US); Michael J. Sullivan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/642,511

(22) Filed: Dec. 18, 2009

(65) Prior Publication Data

US 2010/0099515 A1 Apr. 22, 2010

Related U.S. Application Data

(60) Division of application No. 11/468,879, filed on Aug. 31, 2006, now Pat. No. 7,641,571, which is a continuation-in-part of application No. 11/191,087, filed on Jul. 27, 2005, now Pat. No. 7,452,291, which is a continuation-in-part of application No. 11/061,338, filed on Feb. 18, 2005, now Pat. No. 7,331,878, and a continuation-in-part of application No. 10/974,144, filed on Oct. 27, 2004, now abandoned, and a continuation-in-part of application No. 10/671,853, filed on Sep. 26, 2003, now Pat. No. 6,962,539, and a continuation-in-part of application No. 10/440,984, filed on May 19, 2003, now Pat. No. 6,995,191, and a continuation-in-part of application No. 10/414,879, filed on Apr. 16, 2003, now Pat. No. 6,929,567.

(51) Int. Cl.
*A63B 37/06* (2006.01)

(52) U.S. Cl. ..... 473/376

(58) Field of Classification Search ..... 473/373, 473/374, 376

See application file for complete search history.

(56) References Cited

U.S. PATENT DOCUMENTS

2005/0009636 A1* 1/2005 Kuntimaddi et al. ..... 473/351

* cited by examiner

*Primary Examiner*—Raeann Trimiew
(74) *Attorney, Agent, or Firm*—Mandi B. Milbank

(57) ABSTRACT

The present invention provides high moment of inertia golf balls comprising a low specific gravity core layer formed from a moisture resistant composition. The moisture resistant composition has a moisture vapor transmission rate (MVTR) of 12.5 g·mil/100 $in^2$/day or less and comprises a highly neutralized acid polymer. Golf balls of the invention have a moment of inertia of 85 g·$cm^2$ or greater.

3 Claims, No Drawings

HIGHLY-NEUTRALIZED ACID POLYMER COMPOSITIONS HAVING A LOW MOISTURE VAPOR TRANSMISSION RATE AND THEIR USE IN GOLF BALLS

CROSS-REFERENCE TO RELATED APPLICATIONS

This application is a division of U.S. patent application Ser. No. 11/468,879, filed Aug. 31, 2006, now U.S. Pat. No. 7,641,571, which is a continuation-in-part of U.S. patent application Ser. No. 11/191,087, filed Jul. 27, 2005, now U.S. Pat. No. 7,452,291, which is a continuation-in-part of the following five U.S. Patent Applications: U.S. patent application Ser. No. 11/061,338, filed Feb. 18, 2005, now U.S. Pat. No. 7,331,878; U.S. patent application Ser. No. 10/440,984, filed May 19, 2003, now U.S. Pat. No. 6,995,191; U.S. patent application Ser. No. 10/671,853, filed Sep. 26, 2003, now U.S. Pat. No. 6,962,539; U.S. patent application Ser. No. 10/974,144, filed Oct. 27, 2004 now abandoned; and U.S. patent application Ser. No. 10/414,879, filed Apr. 16, 2003, now U.S. Pat. No. 6,929,567; the entire disclosures of which are hereby incorporated herein by reference.

FIELD OF THE INVENTION

The present invention generally relates to high moment of inertia golf balls having a core layer formed from a moisture resistant composition. The moisture resistant composition comprises a highly neutralized acid polymer and has a reduced specific gravity.

BACKGROUND OF THE INVENTION

Spin rate is an important characteristic of golf balls for both skilled and recreational golfers. High spin rate allows skilled players, such as professionals and low handicapped players, to maximize control of the golf ball. For example, in an approach shot to the green, a high spin rate golf ball allows a player to produce and control back spin to stop the ball on the green. High spin rate also allows a player to produce and control side spin to draw or fade the ball. Thus, skilled players generally prefer golf balls having high spin rate.

On the other hand, recreational players generally prefer low spin golf balls. Recreational players typically cannot control the spin of the ball and tend to unintentionally create side spin when striking the ball, which sends the ball off its intended course. Low spin rate reduces side spin. Thus, recreational players generally prefer golf balls having low spin rate.

One way to control the spin rate of golf balls is reallocating the density or specific gravity of the various layers in the ball. For example, the weight from the outer portions of the ball can be redistributed to the center of the ball to decrease the moment of inertia thereby increasing the spin rate.

Various golf ball constructions are limited, however, by the properties of the materials used to form the layers. For example, conventional golf ball core materials, such as polybutadiene rubber, have a tendency to absorb moisture when exposed to atmospheric moisture for prolonged periods, which can lead to undesirable golf ball properties and performance. Thus, in some golf ball constructions, a moisture vapor barrier layer is necessary to prevent exposure of the core to atmospheric moisture or water. Also, urethane, known to be useful as a golf ball cover layer material, has a high moisture vapor transmission rate. Thus, golf balls having a urethane cover typically require a layer underneath having a low moisture vapor transmission rate.

A desire remains in the golf ball industry for compositions having low moisture vapor transmission rates to allow placement of a layer formed from such composition anywhere from the center or core to the surface without regard for the affect of ambient moisture on the layer. The present invention describes such compositions and the use thereof in low spin golf balls.

SUMMARY OF THE INVENTION

In one embodiment, the present invention is directed to a golf ball having a moment of inertia of 85 $g \cdot cm^2$ or greater and comprising a hollow core, a foamed intermediate layer surrounding the core, and a cover. The foamed intermediate layer is formed from a moisture resistant composition having a moisture vapor transmission rate of 12.5 $g \cdot mil/100\ in^2/day$ or less and comprising a highly neutralized acid polymer.

DETAILED DESCRIPTION OF THE INVENTION

Redistributing the weight or mass of a golf ball changes the dynamic characteristics of the ball at impact and in flight. For example, if the density is shifted or redistributed toward the center of the ball, the moment of inertia is reduced, and the initial spin rate of the ball as it leaves the golf club increases due to lower resistance from the ball's moment of inertia. Conversely, if the density is shifted or redistributed toward or within the outer cover, the moment of inertia is increased, and the initial spin rate of the ball as it leaves the golf club decreases due to higher resistance from the ball's moment of inertia.

The point in a golf ball at which the moment of inertia switches from being increased to being decreased as a result of the redistribution of weight or mass density is referred to as the centroid radius, and is given in terms of radial distance from the center or outer cover of the ball. The method for calculating the centroid radius of a golf ball is disclosed in U.S. Pat. No. 6,494,795, the entire disclosure of which is hereby incorporated herein by reference. For a golf ball weighing 46 grams (1.62 ounces) and having a diameter of 1.68 inches, the centroid radius is located about 0.65 inches radially from the center of the ball and about 0.19 inches radially from the surface of the ball.

When more of the ball's mass or weight is reallocated to a portion of the ball that is positioned between the center and the centroid radius, the moment of inertia is decreased, thereby producing a high spin ball. Such high spin ball is also referred to herein as a low moment of inertia ball. When more of the ball's mass or weight is reallocated to a portion of the ball that is positioned between the centroid radius and the outer cover, the moment of inertia is increased, thereby producing a low spin ball. Such low spin ball is also referred to herein as a high moment of inertia ball.

The moment of inertia for a 1.62 oz golf ball having a diameter of 1.68 inches with evenly distributed weight through any diameter is 0.4572 $oz \cdot in^2$ (83.628 $g \cdot cm^2$). Thus, for purposes of the present disclosure, golf balls having a moment of inertia $>0.4572\ oz \cdot in^2$ are considered high moment of inertia golf balls and golf balls with a moment of inertia $<0.4572\ oz \cdot in^2$ are considered low moment of inertia golf balls. For example, a golf ball having a thin shell positioned at 0.04 inches from the outer surface of the golf ball (or 0.8 inches from the center), has the following moments of inertia.

| Weight of Thin Shell (oz) | Moment of Inertia (oz · in$^2$) | Moment of Inertia (g · cm$^2$) |
|---|---|---|
| 0.20 | 0.4861 | 88.9 |
| 0.405 | 0.5157 | 94.3 |
| 0.81 | 0.5742 | 105.0 |
| 1.61 | 0.6898 | 126.2 |

Moment of inertia was measured on a model number MOI-005-104 Moment of Inertia Instrument manufactured by Inertia Dynamics of Collinsville, Conn. The instrument was connected to a PC for communication via a COMM port and was driven by MOI Instrument Software version #1.2.

Golf balls of the present invention have a high moment of inertia. As used herein, "high moment of inertia" golf balls include golf balls having a moment of inertia of 84 g·cm$^2$ or greater, preferably 85 g·cm$^2$ or greater, more preferably 86 g·cm$^2$ or greater, more preferably 90 g·cm$^2$ or greater, and even more preferably 95 g·cm$^2$ or greater. As used herein, "low specific gravity" includes specific gravities of 1.05 and less, preferably 1.00 and less, more preferably 0.95 and less, and even more preferably 0.85 and less. As used herein, "high specific gravity" includes specific gravities of 1.15 and greater, preferably 1.2 and greater, and more preferably 1.5 and greater.

Golf balls of the present invention have at least one low specific gravity core layer formed from a moisture resistant composition, or have a hollow core with an intermediate layer formed from a moisture resistant composition. In a particular embodiment, the moisture resistant composition is foamed. In another particular embodiment, the moisture resistant composition comprises specific gravity reducing filler(s). Methods for adjusting the specific gravity of golf ball layers of the present invention, such as foaming and the use of fillers, are discussed further herein.

For purposes of the present disclosure, a composition is "moisture resistant" if it has a moisture vapor transmission rate ("MVTR") of 12.5 g·mil/100 in$^2$/day or less. Preferably, the moisture resistant compositions of the present invention have an MVTR of 8.0 g·mil/100 in$^2$/day or less, or 6.5 g·mil/100 in$^2$/day or less, or 5.0 g·mil/100 in$^2$/day or less, or 4.0 g·mil/100 in$^2$/day or less, or 2.5 g·mil/100 in$^2$/day or less, or 2.0 g·mil/100 in$^2$/day or less. As used herein, moisture vapor transmission rate (MVTR) is given in g-mil/100 in$^2$/day, and is measured at 20° C., and according to ASTM F1249-99.

Suitable moisture resistant compositions comprise a highly neutralized acid polymer (HNP) and optionally one or more additional materials including, but not limited to, organic acids and salts thereof, fillers, additives, and non-fatty acid melt flow modifiers. In a preferred embodiment, the moisture resistant composition consists essentially of an HNP and optionally one or more additional materials selected from the group consisting of organic acids and salts thereof, fillers, additives, and non-fatty acid melt flow modifiers. Consisting essentially of, as used herein, means that the recited components are essential, while smaller amounts of other components may be present to the extent that they do not detract from the operability of the present invention.

As used herein, "highly neutralized" refers to the acid polymer after at least 70%, preferably at least 80%, more preferably at least 90%, even more preferably at least 95%, and even more preferably 100%, of the acid groups thereof are neutralized. The HNP may be neutralized by a cation, a salt of an organic acid, a suitable base of an organic acid, or any combination of one or more thereof.

Suitable HNPs are salts of homopolymers and copolymers of α,β-ethylenically unsaturated mono- or dicarboxylic acids, and combinations thereof. The term "copolymer," as used herein, includes polymers having two types of monomers, those having three types of monomers, and those having more than three types of monomers. Preferred acids are (meth) acrylic acid, ethacrylic acid, maleic acid, crotonic acid, fumaric acid, itaconic acid. (Meth) acrylic acid is particularly preferred. As used herein, "(meth) acrylic acid" means methacrylic acid and/or acrylic acid. Likewise, "(meth)acrylate" means methacrylate and/or acrylate. Preferred acid polymers are copolymers of a $C_3$ to $C_8$ α,β-ethylenically unsaturated mono- or dicarboxylic acid and ethylene or a $C_3$ to $C_6$ α-olefin, optionally including a softening monomer. Particularly preferred acid polymers are copolymers of ethylene and (meth) acrylic acid.

When a softening monomer is included, the acid polymer is referred to herein as an E/X/Y-type copolymer, wherein E is ethylene, X is a $C_3$ to $C_8$ α,β-ethylenically unsaturated mono- or dicarboxylic acid, and Y is a softening monomer. The softening monomer is typically an alkyl (meth)acrylate, wherein the alkyl groups have from 1 to 8 carbon atoms. Preferred E/X/Y-type copolymers are those wherein X is (meth) acrylic acid and/or Y is selected from (meth)acrylate, n-butyl (meth)acrylate, isobutyl (meth)acrylate, methyl (meth)acrylate, and ethyl(meth)acrylate. More preferred E/X/Y-type copolymers are ethylene/(meth) acrylic acid/n-butyl acrylate, ethylene/(meth) acrylic acid/methyl acrylate, and ethylene/(meth) acrylic acid/ethyl acrylate.

The amount of ethylene or $C_3$ to $C_6$ α-olefin in the acid copolymer is typically at least 15 wt %, preferably at least 25 wt %, more preferably at least 40 wt %, and even more preferably at least 60 wt %, based on the total weight of the copolymer. The amount of $C_3$ to $C_8$ α,β-ethylenically unsaturated mono- or dicarboxylic acid in the acid copolymer is typically within a range having a lower limit of 1 wt %, or 3 wt %, or 4 wt %, or 5 wt %, and an upper limit of 20 wt %, or 25 wt %, or 30 wt %, or 35 wt %, based on the total weight of the copolymer. The amount of optional softening comonomer in the acid copolymer is typically within a range having a lower limit of 0 wt %, or 5 wt %, 10 wt %, 15 wt %, and an upper limit of 20 wt %, or 30 wt %, or 35 wt %, or 40 wt %, or 50 wt %, based on the total weight of the copolymer.

The acid polymer may be partially neutralized prior to being neutralized to 70% and higher. Suitable partially neutralized acid polymers include, but are not limited to, Surlyn® and DuPont® HPF ionomers, commercially available from E.I. du Pont de Nemours and Company; AClyn® ionomers, commercially available from Honeywell International Inc.; and Iotek® ionomers, commercially available from ExxonMobil Chemical Company.

In a particular embodiment, the acid polymer is selected from Nucrel® acid copolymers, commercially available from E.I. du Pont de Nemours and Company (such as Nucrel® 960, an ethylene/methacrylic acid copolymer); Primacor® polymers, commercially available from Dow Chemical Company (such as Primacor® XUS 60758.08L and XUS60751.18, ethylene/acrylic acid copolymers containing 13.5 wt % and 15.0 wt % acid, respectively); and partially neutralized ionomers thereof.

Additional suitable acid polymers are more fully described, for example, in U.S. Pat. No. 6,953,820 and U.S. Patent Application Publication No. 2005/0049367, the entire disclosures of which are hereby incorporated herein by reference.

The acid polymers of the present invention can be direct copolymers wherein the polymer is polymerized by adding all monomers simultaneously, as described in, for example, U.S. Pat. No. 4,351,931, the entire disclosure of which is hereby incorporated herein by reference. Ionomers can be made from direct copolymers, as described in, for example, U.S. Pat. No. 3,264,272 to Rees, the entire disclosure of which is hereby incorporated herein by reference. Alternatively, the acid polymers of the present invention can be graft copolymers wherein a monomer is grafted onto an existing polymer, as described in, for example, U.S. Patent Application Publication No. 2002/0013413, the entire disclosure of which is hereby incorporated herein by reference.

Cations suitable for neutralizing the acid polymers of the present invention are selected from silicone, silane, and silicate derivatives and complex ligands; metal ions and compounds of rare earth elements; metal ions and compounds of alkali metals, alkaline earth metals, and transition metals; and combinations thereof. Particular cation sources include, but are not limited to, metal ions and compounds of lithium, sodium, potassium, magnesium, cesium, calcium, barium, manganese, copper, zinc, tin, rare earth metals, and combinations thereof. In a particular embodiment, the cation source is selected from metal ions and compounds of calcium, metal ions and compounds of zinc, and combinations thereof. In a particular aspect of this embodiment, the equivalent percentage of calcium and/or zinc salt(s) in the final composition is 50% or higher, or 60% or higher, or 70% or higher, or 80% or higher, or 90% or higher, based on the total salts present in the final composition, wherein the equivalent % is determined by multiplying the mol % of the cation by the valence of the cation. In another particular embodiment, the cation source is selected from metal ions and compounds of lithium, sodium, potassium, magnesium, calcium, zinc, and combinations thereof. A particular potassium-based cation source is Oxone®, commercially available from E.I. du Pont de Nemours and Company. Oxone® is a monopersulfate compound wherein potassium monopersulfate is the active ingredient present as a component of a triple salt of the formula $2KHSO_5.KHSO_4.K_2SO_4$ [potassium hydrogen peroxymonosulfate sulfate (5:3:2:2)]. In another particular embodiment, the cation source is selected from metal ions and compounds of lithium, metal ions and compounds of zinc, and combinations thereof. Suitable cation sources also include mixtures of lithium and/or zinc cations with other cations. Other cations suitable for mixing with lithium and/or zinc cations to produce the HNP include, but are not limited to, the "less hydrophilic" cations disclosed in U.S. Patent Application Publication No. 2006/0106175; conventional HNP cations, such as those disclosed in U.S. Pat. Nos. 6,756,436 and 6,824,477; and the cations disclosed in U.S. Patent Application Publication No. 2005/026740. The entire disclosure of each of these references is hereby incorporated herein by reference. In a particular aspect of this embodiment, the percentage of lithium and/or zinc salts in the composition is preferably 50% or higher, or 55% or higher, or 60% or higher, or 65% or higher, or 70% or higher, or 80% or higher, or 90% or higher, or 95% or higher, or 100%, based on the total salts present in the composition. The amount of cation source used is readily determined based on the desired level of neutralization.

Moisture resistant compositions of the present invention optionally comprise one or more organic acids and/or salts thereof. Suitable organic acids are aliphatic organic acids, aromatic organic acids, saturated mono-functional organic acids, unsaturated monofunctional organic acids, multi-unsaturated mono-functional organic acids, and dimerized derivatives thereof. Particularly suitable are aliphatic, mono-functional (saturated, unsaturated, or multi-unsaturated) organic acids, preferably having fewer than 36 carbon atoms. Particular examples of suitable organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, salts thereof, and dimerized derivatives thereof. Particularly suitable organic acid salts include those produced by a cation source selected from barium, lithium, sodium, zinc, bismuth, potassium, strontium, magnesium, calcium, and combinations thereof. Suitable organic acids are more fully described, for example, in U.S. Pat. No. 6,756,436, the entire disclosure of which is hereby incorporated herein by reference.

Moisture resistant compositions of the present invention optionally contain one or more additives and/or one or more fillers. Suitable additives include, but are not limited to, chemical blowing and foaming agents, optical brighteners, coloring agents, fluorescent agents, whitening agents, UV absorbers, light stabilizers, defoaming agents, processing aids, mica, talc, nano-fillers, antioxidants, stabilizers, softening agents, fragrance components, plasticizers, impact modifiers, acid copolymer wax, and surfactants. Suitable fillers include, but are not limited to, inorganic fillers, such as zinc oxide, titanium dioxide, tin oxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., core material that is ground and recycled; and nano-fillers. Filler materials may be dual-functional fillers, for example, zinc oxide (which may be used as a filler/acid scavenger) and titanium dioxide (which may be used as a filler/brightener material). Further examples of suitable fillers and additives include, but are not limited to, those disclosed in U.S. Patent Application Publication No. 2003/0225197, the entire disclosure of which is hereby incorporated herein by reference Moisture resistant compositions of the present invention optionally contain one or more non-fatty acid melt flow modifiers. Suitable non-fatty acid melt flow modifiers include polyamides, polyesters, polyacrylates, polyurethanes, polyethers, polyureas, polyhydric alcohols; and combinations thereof. Additional melt flow modifiers, suitable for use in compositions of the present invention, include those described in copending U.S. Patent Application Publication No. 2006/0063893 and U.S. patent application Ser. No. 11/216,726, the entire disclosures of which are hereby incorporated herein by reference.

Moisture resistant compositions of the present invention are optionally produced by blending the HNP with one or more additional polymers, such as thermoplastic polymers and elastomers. Examples of thermoplastic polymers suitable for blending with the invention HNPs include, but are not limited to, polyolefins, polyamides, polyesters, polyethers, polyether-esters, polyether-amides, polyether-urea, polycarbonates, polysulfones, polyacetals, polylactones, acrylonitrile-butadiene-styrene resins, polyphenylene oxide, polyphenylene sulfide, styrene-acrylonitrile resins, styrene maleic anhydride, polyimides, aromatic polyketones, ionomers and ionomeric precursors, acid homopolymers and copolymers, conventional ionomers and HNPs (e.g., ionomeric materials sold under the trade names DuPont® HPF 1000 and DuPont® HPF 2000, commercially available from E.I. du Pont de Nemours and Company), rosin-modified ionomers, bimodal ionomers, polyurethanes, grafted and non-grafted metallocene-catalyzed polymers, single-site catalyst polymerized polymers, high crystalline acid polymers, cationic ionomers, epoxy-functionalized polymers, anhydride-functionalized polymers, and combinations thereof. Particular polyolefins suitable for blending include one or more, linear, branched, or cyclic, $C_2$-$C_{40}$ olefins, particularly polymers comprising ethylene or propylene copolymerized with one or more $C_2$-$C_{40}$ olefins, $C_3$-$C_{20}$ α-olefins, or $C_3$-$C_{10}$ α-olefins. Particular conventional HNPs suitable for blending include, but are not limited to, one or more of the HNPs disclosed in U.S. Pat. Nos. 6,756,436, 6,894,098, and 6,953,820, the entire disclosures of which are hereby incorporated herein by reference. Examples of elastomers suitable for blending with the invention polymers include natural and synthetic rubbers, including, but not limited to, ethylene propylene rubber ("EPR"), ethylene propylene diene rubber ("EPDM"), hydrogenated and non-hydrogenated styrenic block copolymer rubbers (such as SI, SIS, SB, SBS, SIBS, and the like, where "S" is styrene, "I" is isobutylene, and "B" is butadiene), butyl rubber, halobutyl rubber, copolymers of isobutylene and para-alkylstyrene, halogenated copolymers of isobutylene and para-alkylstyrene, natural rubber, polyisoprene, copolymers of butadiene with acrylonitrile, polychloroprene, alkyl acrylate rubber, chlorinated isoprene rubber, acrylonitrile chlorinated isoprene rubber, polybutadiene rubber, and thermoplastic vulcanizates. Additional suitable blend polymers include those described in U.S. Pat. No. 5,981,658, for example at column 14, lines 30 to 56, and in U.S. Patent Application Publication No. 2005/0267240, for example at paragraph [0073], the entire disclosures of which are hereby incorporated herein by reference. The blends described herein may be produced by post-reactor blending, by connecting reactors in series to make reactor blends, or by using more than one catalyst in the same reactor to produce multiple species of polymer. The polymers may be mixed prior to being put into an extruder, or they may be mixed in an extruder.

The present invention is not limited by any particular method or any particular equipment for making the moisture resistant composition. In a preferred embodiment, the composition is prepared by the following process. An acid polymer, preferably ethylene/(meth) acrylic acid, and optional additional materials such as an organic acid or salt thereof, additives, filler, and non-fatty acid melt flow modifier, are melt blended, for example in a single or twin screw extruder. A suitable amount of a cation source is added to the molten acid polymer composition such that at least 70% of all acid groups present are neutralized, including the acid groups of the acid polymer and the acid groups of the optional organic acid. Preferably at least 80%, more preferably at least 90%, more preferably at least 95%, and even more preferably at least 100%, of all acid groups present are neutralized. The acid polymer may be partially neutralized prior to contact with the cation source, preferably with a cation source selected from metal ions and compounds of calcium, magnesium, and zinc. The acid polymer/cation mixture is intensively mixed prior to being extruded as a strand from the die-head. In a particular aspect of this embodiment, the acid polymer is a ethylene/(meth) acrylic acid polymer selected from Nucrel® acid copolymers, commercially available from E.I. du Pont de Nemours and Company (such as Nucrel® 960, an ethylene/methacrylic acid copolymer) and Primacor® polymers, commercially available from Dow Chemical Company (such as Primacor® XUS 60758.08L and XUS60751.18, ethylene/acrylic acid copolymers containing 13.5 wt % and 15.0 wt % acid, respectively).

Further examples of suitable moisture resistant compositions include, but are not limited to, compositions containing an HNP neutralized by a less hydrophilic cation source as disclosed in U.S. Patent Application Publication No. 2006/0106175, the entire disclosure of which is hereby incorporated herein by reference.

In order to be processable, the moisture resistant composition of the present invention has a melt flow index of at least 0.5 g/10 min (190° C., 2.16 kg). Preferably, the melt flow index of the moisture resistant composition is at least 0.8 g/10 min, or within the range having a lower limit of 0.8 or 1.0 g/10 min, and an upper limit of 4.0 or 5.0 or 10.0 g/10 min. For purposes of the present disclosure, melt flow index is measured according to ASTM D1238.

Golf balls of the present invention have at least one layer formed from a composition other than the moisture resistant composition disclosed above. Suitable materials for golf ball core, intermediate and cover layers of the present invention include, but are not limited to, polyethylene, including, for example, low density polyethylene, linear low density polyethylene, and high density polyethylene; polypropylene; rubber-toughened olefin polymers; copolyether-esters; copolyether-amides; polycarbonates; acid copolymers which do not become part of an ionomeric copolymer; plastomers; flexomers; vinyl resins, such as those formed by the copolymerization of vinyl chloride with vinyl acetate, acrylic esters or vinylidene chloride; styrene/butadiene/styrene block copolymers; styrene/ethylene-butylene/styrene block copolymers; dynamically vulcanized elastomers; ethylene vinyl acetates; ethylene methacrylates and ethylene ethacrylates; ethylene methacrylic acid, ethylene acrylic acid, and propylene acrylic acid; polyvinyl chloride resins; copolymers and homopolymers produced using a metallocene or other single-site catalyst; polyamides, amide-ester elastomers, and graft copolymers of ionomer and polyamide, including, for example, Pebax® thermoplastic polyether block amides, commercially available from Arkema Inc; polyphenylene oxide resins or blends of polyphenylene oxide with high impact polystyrene, such as NORYL®, commercially available by General Electric Company of Pittsfield, Mass.; crosslinked transpolyisoprene blends; polyurethanes; polyureas; polyester-based thermoplastic elastomers, such as Hytrel®, commercially available from E.I. du Pont de Nemours and Company, and LOMOD®, commercially available from General Electric Company; polyurethane-based thermoplastic elastomers, such as Elastollan®, commercially available from BASF; natural and synthetic rubbers; partially and fully neutralized ionomers; and combinations thereof. Suitable golf ball materials and constructions also include, but are not limited to, those disclosed in U.S. Pat. Nos. 6,117,025, 6,767,940, and 6,960,630, the entire disclosures of which are hereby incorporated herein by reference.

Ionomeric copolymers of ethylene and unsaturated monocarboxylic acids are a preferred composition for intermediate and cover layers of golf balls of the present invention. Particularly preferred are Surlyn® and HPF ionomers, commercially available from E.I. du Pont de Nemours and Company; AClyn® ionomers, commercially available from Honeywell International Inc.; and Iotek® and Escor® ionomers, commercially available from ExxonMobil Chemical Company. Surlyn®, HPF, AClyn®, Iotek®, and Escor® ionomers, are copolymers or terpolymers of ethylene and (meth) acrylic acid partially or fully neutralized with salts of zinc, sodium, lithium, magnesium, potassium, calcium, manganese, nickel, or the like.

Preferred materials for intermediate and cover layers of golf balls of the present invention also include ethylene, propylene, butene-1, and hexane-1 homopolymers; copolymers of ethylene, propylene, butene-1, or hexane-1 and (meth)

acrylic acid, and partially or fully neutralized ionomers thereof; methyl acrylate and methyl methacrylate homopolymers and copolymers; imidized, amino group-containing polymers; polycarbonate; reinforced polyamides; polyphenylene oxide; high impact polystyrene; polyether ketone; polysulfone; polyphenylene sulfide; acrylonitrile-butadiene; acrylic-styrene-acrylonitrile; polyethylene terephthalate; polybutylene terephthalate; polyvinyl alcohol; polytetrafluoroethylene; copolymers thereof; and blends thereof.

Polyurethanes and polyureas are also preferred for intermediate and cover layers of golf balls of the present invention. Suitable polyurethanes include those prepared from polyisocyanates and a curing agent, and those disclosed in U.S. Pat. Nos. 5,334,673, 6,506,851, and 6,867,279, and U.S. Patent Application Publication No. 2005/0176523, the entire disclosures of which are hereby incorporated herein by reference. Suitable polyureas include those disclosed in U.S. Pat. Nos. 5,484,870 and 6,835,794, and U.S. Patent Application Publication No. 2005/0176523, the entire disclosures of which are hereby incorporated herein by reference. Also suitable are polyurethane-urea hybrids, i.e., blends and copolymers comprising urethane and/or urea segments. Thermoset polyurethanes and polyureas are particularly preferred for the outer cover layers of golf balls of the present invention.

Saturated polyurethanes are a particularly preferred material for forming cover layers, and more particularly for outer cover layers, of golf balls of the present invention. Suitable saturated polyurethanes are a product of a reaction between at least one polyurethane prepolymer and at least one saturated curing agent. Polyurethane prepolymers are a product formed by a reaction between at least one saturated polyol and at least one saturated diisocyanate. Saturated polyols, saturated diisocyanates, and saturated curatives are further disclosed in U.S. Patent Application Publication No. 2005/0176523, the entire disclosure of which is hereby incorporated herein by reference.

Also preferred for cover layer materials, particularly inner cover layer materials, are E/X/Y-type copolymers, wherein E is ethylene, X is (meth) acrylic acid, and Y is an acrylate- or methacrylate-based softening comonomer. Preferably, the amount of ethylene present in the copolymer is at least 40 wt %, based on the total weight of the copolymer, the amount of acid present in the copolymer is from 5 wt % to 35 wt %, based on the total weight of the copolymer, and the amount of the softening comonomer present in the copolymer is from 0 wt % to 50 wt %, based on the total weight of the copolymer. In a particular embodiment designed for low spin, the inner cover layer is formed from an E/X/Y-type copolymer wherein the acid is present in the copolymer an amount of from 16 wt % to 35 wt %, based on the total weight of the copolymer. In a particular embodiment designed for high spin, the inner cover layer is formed from an E/X/Y-type copolymer wherein the acid is present in the copolymer in an amount of from 10 wt % to 15 wt %, based on the total weight of the copolymer, and includes a softening comonomer.

Crosslinked rubber compositions are also suitable for golf ball layers of the present invention, and are particularly suitable for golf ball core layers. Suitable crosslinked rubber compositions generally comprise a base rubber and optionally fillers and/or additives. Suitable rubber compositions may also contain a cis-to-trans conversion compound, such as a halogenated organosulfur, organic disulfide, or inorganic disulfide compound. The base rubber is generally selected from polybutadiene rubber, polyisoprene rubber, natural rubber, ethylene propylene rubber, ethylene propylene diene rubber, styrene-butadiene rubber, and combinations of two or more thereof. A preferred base rubber is one or more polybutadiene(s). Particularly suitable polybutadiene blends are disclosed, for example, in U.S. Pat. No. 6,774,187, the entire disclosure of which is hereby incorporated herein by reference. Another preferred base rubber is one or more polybutadiene(s) optionally mixed with one or more elastomer(s) selected from polyisoprene rubber, natural rubber, ethylene propylene rubber, ethylene propylene diene rubber, styrene-butadiene rubber, polystyrene elastomers, polyethylene elastomers, polyurethane elastomers, polyurea elastomers, metallocene-catalyzed elastomers, and plastomers.

Suitable rubber composition additives include free radical scavengers, scorch retarders, coloring agents, fluorescent agents, chemical blowing and foaming agents, defoaming agents, stabilizers, softening agents, impact modifiers, and the like. Suitable rubber composition filler materials include particulate fillers selected from inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., core material that is ground and recycled; and nano-fillers. Filler materials may be dual-functional fillers, for example, zinc oxide (which may be used as a filler/acid scavenger) and titanium dioxide (which may be used as a filler/brightener material). Further examples of suitable fillers and additives include, but are not limited to, those disclosed in U.S. Patent Application Publication No. 2003/0225197, the entire disclosure of which is hereby incorporated herein by reference.

The rubber composition is typically cured using a conventional curing process. Suitable curing processes include, for example, peroxide curing, sulfur curing, radiation, and combinations thereof. Organic peroxides suitable as free radical initiators include, for example, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy)hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. Coagents can be used with peroxides to increase the state of cure. Suitable coagents include, for example, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particularly suitable metal salts include, for example, one or more metal salts of acrylates, diacrylates, methacrylates, and dimethacrylates, wherein the metal is selected from magnesium, calcium, zinc, aluminum, lithium, and nickel. In a particular embodiment, the coagent is selected from zinc salts of acrylates, diacrylates, methacrylates, and dimethacrylates. In another particular embodiment, the coagent is zinc diacrylate.

Sulfur and sulfur-based curing agents with optional accelerators may be used in combination with or in replacement of the peroxide initiators to crosslink the base rubber. Suitable curing agents and accelerators include, for example, sulfur; N-oxydiethylene 2-benzothiazole sulfenamide; N,N-diorthotolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates;

aldehyde-amines; dibenzothiazyl disulfide; tetraethylthiuram disulfide; tetrabutylthiuram disulfide; and combinations thereof.

High energy radiation sources capable of generating free radicals may also be used to crosslink the base rubber. Suitable examples of such radiation sources include, for example, electron beams, ultra-violet radiation, gamma radiation, X-ray radiation, infrared radiation, heat, and combinations thereof.

Further examples of suitable free radical initiators, coagents, and curing agents are disclosed in U.S. Patent Application Publication Nos. 2004/0214661 and 2003/0144087 and U.S. Pat. Nos. 6,566,483, 6,695,718, and 6,939,907, the entire disclosures of which are hereby incorporated by reference.

In some embodiments, the present invention provides a golf ball having a thin dense layer. Thin dense layers generally have a specific gravity of 1.2 or greater, or 1.5 or greater, or 1.8 or greater, or 2 or greater, and a thickness within the range having a lower limit of 0.001 inches or 0.005 inches or 0.01 inches and an upper limit of 0.05 inches or 0.03 inches or 0.02 inches. When included in golf balls of the present invention, the thin dense layer is located outside of the centroid radius and is preferably located from 0.030 inches to 0.110 inches from the outer surface of the ball. The thin dense layer is preferably applied to the core as a liquid solution, dispersion, lacquer, paste, gel, melt, etc., such as a loaded or filled natural or non-natural rubber latex, polyurethane, polyurea, epoxy, polyester, any reactive or non-reactive coating or casting material; and then cured, dried or evaporated down to the equilibrium solids level. The thin dense layer may also be formed by compression or injection molding, RIM, casting, spraying, dipping, powder coating, or any means of depositing materials onto the inner core. The thin dense layer may also be a thermoplastic polymer loaded with a specific gravity increasing filler, fiber, flake or particulate, such that it can be applied as a thin coating and meets the preferred specific gravity levels discussed above. One particular example of a thin dense layer, which was made from a soft polybutadiene with tungsten powder using the compression molded method, has a thickness of from 0.021 inches to 0.025 inches, a specific gravity of 1.31, and a Shore C hardness of about 72. For reactive liquid systems, the suitable materials include any material which reacts to form a solid such as epoxies, styrenated polyesters, polyurethanes or polyureas, liquid polybutadienes, silicones, silicate gels, agar gels, etc. Casting, RIM, dipping and spraying are the preferred methods of applying a reactive thin dense layer. Non-reactive materials include any combination of a polymer either in melt or flowable form, powder, dissolved or dispersed in a volatile solvent. Suitable thermoplastic materials for forming the thin dense layer are further disclosed in U.S. Pat. Nos. 6,149,535 and 6,152,834, the entire disclosures of which are hereby incorporated herein by reference. Also suitable for forming the thin dense layer are the materials disclosed in U.S. Pat. No. 6,494,795, the entire disclosure of which is hereby incorporated herein by reference. Thin dense layer are more fully disclosed in U.S. Patent Application Publication No. 2005/0059510, the entire disclosure of which is hereby incorporated herein by reference.

Golf balls of the present invention have at least one layer in which the specific gravity is adjusted to control the ball's moment of inertia. The specific gravity of a golf ball layer can be reduced by known methods, such as foaming and the use of low density fillers. The specific gravity of a golf ball layer can be increased by known methods, such as the use of high density fillers. Suitable methods for adjusting the specific gravity of a golf ball layer are further described below.

Foaming, including physical and chemical foaming, is a preferred method for reducing the specific gravity. Suitable foaming agents include volatile liquids such as freons (CFCs), other halogenated hydrocarbons, water, aliphatic hydrocarbons, gases, and solid blowing agents, i.e., compounds that liberate gas as a result of desorption of gas. Preferably, the blowing agent includes an adsorbent, e.g., activated carbon, calcium carbonate, diatomaceous earth, and silicates saturated with carbon dioxide. Chemical foaming/blowing agents are preferred for reducing the specific gravity of a layer formed from thermoplastics such as ionomers, highly neutralized polymers, and polyolefins. Suitable chemical foaming/blowing agents include inorganic agents, such as ammonium carbonate and carbonates of alkalai metals, and organic agents, such as azo and diazo compounds (e.g., nitrogen-based azo compounds). Examples of suitable azo compounds include, but are not limited to 2,2'-azobis(2-cyanobutane); 2,2'-azobis(methylbutyronitrile); azodicarbonamide; p,p'-oxybis(benzene sulfonyl hydrazide); p-toluene sulfonyl semicarbazide; and p-toluene sulfonyl hydrazide. Other suitable blowing agents include any of the Celogens® sold by Crompton Chemical Corporation, nitroso compounds, sulfonylhydrazides, azides of organic acids and their analogs, triazines, tri- and tetrazole derivatives, sulfonyl semicarbazides, urea derivatives, guanidine derivatives, and esters such as alkoxyboroxines. Suitable blowing agents also include agents that liberate gasses as a result of chemical interaction between components, e.g., mixtures of acids and metals, mixtures of organic acids and inorganic carbonates, mixtures of nitriles and ammonium salts, and the hydrolytic decomposition of urea.

Suitable foaming agents and foamed materials also include those disclosed in U.S. Patent Application Publication No. 2006/0073914, and the closed-cell foams incorporating microspheres disclosed in U.S. Patent Application Publication No. 2005/0027025, the entire disclosures of which are hereby incorporated herein by reference.

An alternative to chemical or physical foaming is the use of specific-gravity-lowering fillers, including fibers, flakes, spheres, hollow microspheres and microballoons, such as 3M glass (glass bubbles), ceramic (zeospheres), phenolic, as well as other polymer based compositions, such as acrylonitrile, PVDC, and the like. Such specific gravity reducing fillers are further disclosed in U.S. Pat. Nos. 6,692,380, the entire disclosure of which is hereby incorporated herein by reference.

Expandable microspheres are also suitable for reducing specific gravity. Exemplary microspheres consist of an acrylonitrile polymer shell encapsulating a volatile gas, such as isopentane gas. This gas is contained within the sphere as a blowing agent. In their unexpanded state, the diameter of these hollow spheres range from 10 to 17 μm and have a true density of 1000 to 1300 kg/m$^3$. When heated, the gas inside the shell increases its pressure and the thermoplastic shell softens, resulting in a dramatic increase of the volume of the microspheres. Fully expanded, the volume of the microspheres will increase more than 40 times (typical diameter values would be an increase from 10 to 40 μm), resulting in a true density below 30 kg/m$^3$ (0.25 lbs/gallon). Typical expansion temperatures range from 80-190° C. (176-374° F.). Such expandable microspheres are commercially available as EXPANCEL® from Expancel of Sweden or Akzo Nobel. For purposes of the present invention, expandable microspheres are activated during the molding process, using elevated molding temperatures to activate the gas. By initially reducing the volume of component material loaded in the mold, the process relies on the expansion of the microspheres to fill the remainder of space within the cavity during the molding cycle. The dynamic in-mold expansion of the microspheres reduces the density of the material as it fills the volume of the mold, maximizing the potential of the microspheres while minimizing the amount of material required to produce the low specific gravity layer.

Using one of the above processes to reduce the weight of a core layer allows more weight to be placed in outer layers to increase the ball's moment of inertia. For example, adding weight to an outer layer, such as a thin dense layer, provides a ball having a high moment of inertia. Thin dense layers are discussed further below and in U.S. Patent Application Publication No. 2005/0059510, the entire disclosure of which is hereby incorporated herein by reference.

Suitable fillers for achieving a high specific gravity layer include, but are not limited to, metal powders, metal flakes, metal alloy powders, metal oxides, particulates of metal stearates, carbonaceous materials, barium sulfate, and the fillers disclosed in U.S. Pat. No. 6,692,380, the entire disclosure of which is hereby incorporated herein by reference. Examples of suitable metal powders include, but are not limited to, bismuth powder, boron powder, brass powder, bronze powder, cobalt powder, copper powder, nickel-chromium iron metal powder, iron metal powder, molybdenum powder, nickel powder, stainless steel powder, titanium metal powder, zirconium oxide powder, tungsten metal powder, beryllium metal powder, zinc metal powder, and tin metal powder. Preferred metal oxides are zinc oxide, iron oxide, aluminum oxide, titanium dioxide, magnesium oxide, zirconium oxide, and tungsten trioxide. A preferred metal flake is aluminum flake. In a particularly preferred embodiment, the high-density filler is selected from tungsten, tungsten oxide, and tungsten metal powder. Also suitable are the nano and hybrid materials disclosed in U.S. Pat. Nos. 6,793,592 and 6,919,395, the entire disclosures of which are hereby incorporated herein by reference.

Other exemplary materials that may be used in golf ball compositions of the present invention are described in U.S. Pat. Nos. 5,824,746 and 6,025,442 and in PCT Publication No. WO99/52604, all of which are hereby incorporated herein by reference in their entireties.

In a particular embodiment, the present invention is directed to a golf ball having a cover and a low specific gravity core. The low specific gravity core has at least one layer formed from a moisture resistant composition. In a particular aspect of this embodiment, the moisture resistant composition is foamed. In another particular aspect of this embodiment, the moisture resistant composition comprises specific gravity reducing filler(s). The cover is preferably formed from a polyurethane or polyurea composition and preferably has a thickness of 0.03 inches or a thickness within the range having a lower limit of 0.01 inches and an upper limit of 0.045 inches or 0.06 inches. The specific gravity of one or more cover layer(s) is optionally adjusted by one of the methods disclosed herein for adjusting specific gravity. Optionally, the golf ball further comprises a high specific gravity intermediate layer disposed between the low specific gravity core and the outermost cover layer. For purposes of the present disclosure, an intermediate layer can be an outer core layer, mantle layer, or inner cover layer. Preferably, the intermediate layer is formed from a composition comprising a high density filler. More preferably, the intermediate layer is a thin dense layer having a specific gravity of 1.2 or greater and a thickness of from 0.001 inches to 0.05 inches. Thin dense layers are discussed further herein.

In another particular embodiment, the present invention is directed to a golf ball having a hollow core, at least one low specific gravity intermediate layer surrounding the core, and at least one cover layer. At least one of the intermediate layer(s) is formed from a moisture resistant composition. In a particular aspect of this embodiment, the moisture resistant composition is foamed. In another particular aspect of this embodiment, the moisture resistant composition comprises specific gravity reducing filler(s). The hollow core preferably has a diameter of from 0.25 inches to 1.25 inches. The hollow core and low specific gravity intermediate layer(s) are encased in one or more relatively thin, high specific gravity cover layer(s).

Low specific gravity cores of the present invention can be single-, dual-, or multi-layer cores, and preferably have an overall diameter of from 1.50 inches to 1.66 inches. Preferably, the volume of the core is from 80% to 97.5% of the volume of the ball, disregarding the volume of the dimples. Golf ball cores of the present invention may be spherical or non-spherical. Suitable non-spherical shapes for the core layer include, but are not limited to, the shapes disclosed in U.S. Pat. No. 6,595,874, the entire disclosure of which is hereby incorporated herein by reference. In embodiments wherein the core is non-spherical, a combination of the non-spherical core and the intermediate layer preferably results in a sphere having an overall diameter of from 1.50 inches to 1.66 inches.

Dual layer cores of the present invention include an inner core layer and an outer core layer. Preferably, both core layers are foamed and may have the same or different specific gravities. In a particular aspect of this embodiment, the inner core layer is foamed such that the layer's specific gravity is reduced to 0.8 or less, the outer core layer is foamed such that the layer's specific gravity is reduced to 0.9 or less, and the specific gravity of the inner core layer is less than the specific gravity of the inner core layer. In another particular aspect of this embodiment, the inner core layer is foamed such that the layer's specific gravity is reduced to 0.9 or less, the outer core layer is foamed such that the layer's specific gravity is reduced to 0.8 or less, and the specific gravity of the inner core layer is greater than the specific gravity of the inner core layer. Preferably, the inner core layer has a diameter of 1.50 inches or less and the outer core layer has a thickness of from 0.030 inches to 0.150 inches.

While not meant to be limited by a particular weight, golf balls of the present invention typically have a weight within the range having a lower limit of 30 g or 35 g or 38 g and an upper limit of 46 g or 48 g or 50 g.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising:

a hollow core;

a foamed intermediate layer surrounding the core, the foamed intermediate layer being formed from a moisture resistant composition having a moisture vapor transmission rate (MVTR) of 12.5 g·mil/100 $in^2$/day or less and comprising a highly neutralized acid polymer;

a cover; and an unfoamed intermediate layer disposed between the foamed intermediate layer and the cover, the unfoamed intermediate layer having a specific gravity of 1.2 or greater;

wherein the ball has a moment of inertia of 85 $g \cdot cm^2$ or greater.

2. The golf ball of claim 1, wherein the unfoamed intermediate layer is unfilled.

3. The golf ball of claim 1, wherein the unfoamed intermediate layer is formed from a composition comprising a high density filler.

* * * * *